US005232373A

United States Patent [19]

Sawada

[11] Patent Number: 5,232,373

[45] Date of Patent: Aug. 3, 1993

[54] CONNECTOR

[75] Inventor: Yoshitsugu Sawada, Shizuoka, Japan

[73] Assignee: Yazaki Corporation, Japan

[21] Appl. No.: 950,409

[22] Filed: Sep. 23, 1992

[30] Foreign Application Priority Data

Oct. 18, 1991 [JP] Japan ..... 3-85087[U]

[51] Int. Cl.[5] ..... H01R 13/44

[52] U.S. Cl. ..... 439/140; 439/595; 439/596

[58] Field of Search ..... 439/138, 140, 595, 596, 439/367

[56] References Cited

U.S. PATENT DOCUMENTS

| | | | |
|---|---|---|---|
| 4,767,348 | 8/1988 | Murakami | 439/140 |
| 4,857,005 | 8/1989 | Kikuchi et al. | 439/140 |
| 4,867,705 | 9/1989 | Yuasa | 439/595 |
| 4,979,913 | 12/1990 | Aiello et al. . | |
| 5,051,100 | 9/1991 | Kato et al. | 439/140 |

FOREIGN PATENT DOCUMENTS

| | | |
|---|---|---|
| 448476A1 | 9/1991 | European Pat. Off. . |
| 53-104389 | 8/1978 | Japan . |
| 53-146982 | 11/1978 | Japan . |
| 1289423 | 9/1972 | United Kingdom . |
| 1315693 | 5/1973 | United Kingdom . |
| 1447910 | 9/1976 | United Kingdom . |
| 2062979 | 5/1981 | United Kingdom . |

*Primary Examiner*—Paula A. Bradley
*Attorney, Agent, or Firm*—Krass & Young

[57] ABSTRACT

A connector with a cover for connecting an electric wire to a printed circuit board or a like element wherein a half inserted condition of a terminal accommodated in a housing can be detected. A plurality of terminal accommodating chambers each having a flexible arresting piece formed on an inner wall thereof are formed in a housing body and each has a terminal accommodated therein. The terminal is connected at an end thereof to an electric wire and has an engaging hole formed at a rear face of the end portion thereof. The terminal further has a contact piece folded back over itself from the other end to an intermediate portion thereof and has a protrusion formed at an intermediate portion thereof by bending a pair of side plates thereof inwardly toward each other. The contact pieces and protrusions are exposed outside through slots formed in a top plate of the housing body. A plurality of trunnions are formed at an end of the cover and engaged with a plurality of channel-shaped engaging portions formed on the top plate, and a hinge portion of the cover is extended to form a detecting projection.

3 Claims, 12 Drawing Sheets

CONNECTOR

BACKGROUND OF THE INVENTION

1. Field of the Invention

This invention relates to a connector for connecting a printed circuit board or a like element to an electric wire.

2. Description of the Related Art

Various connectors for connecting a printed circuit board or a like element to an electric wire are already known. An exemplary one of conventional connectors is disclosed in Japanese Utility Model Laid-Open Application No. 53-104389 and is shown in FIGS. 10, 11 and 12. Referring to FIGS. 10 to 12, the conventional connector includes a housing body 110 having a plurality of terminal accommodating chambers 111 formed therein. Each of the terminal accommodating chambers 111 has an arresting projection 114 formed therein on the housing body 110. An electric wire 132 is accommodated in each of the terminal accommodating chambers 111 and is connected to an end of a terminal 130 which has a contact piece 131 at the other end thereof and has an engaging hole 133 formed at an intermediate portion thereof. The engaging hole 133 of the terminal 130 cooperates with the arresting projection 114 of the corresponding terminal accommodating chamber 111 to constitute arresting means for arresting the corresponding electric wire 132 in the terminal accommodating chamber 111. A top plate 119 of each of the terminal accommodating chambers 111 is partially cut away so as to expose the contact piece 131 of the terminal 130 partially therethrough.

A cover 113 is formed contiguously to and extends laterally from a portion of the housing body 110 intermediate of the terminal accommodating chambers 111 by way of a flexible portion 112 of a reduced thickness. The cover 113 has an arresting projection 116 formed on an inner face adjacent an end thereof. The arresting projection 116 cooperates with an arresting projection not shown of the housing body 110 to constitute arresting means for arresting the housing body 110 at its closed position. A flexible arresting piece 117 is formed on a face of the housing body 110 remote from the cover 113 and has an arresting projection 118 formed thereon. The arresting projection 118 cooperates with an engaging projection 125 of a casing 120 to constitute arresting means for arresting the housing body 110 at the casing 120.

The casing 120 has a recess or cavity 121 formed at an end portion thereof and has a circuit board portion 123 at the other end portion thereof. A plurality of printed conductors 122 are disposed on the circuit board portion 123 of the casing 120, and each of the printed conductors 122 has a contact terminal 124 in the cavity 121. The contact terminal 124 cooperates with the contact piece 131 of the corresponding connecting terminal 130 on the housing body 110 to constitute sliding contacting means between the printed conductor 122 and the connecting terminal 130, and the cavity 121 constitutes receiving means for receiving an insertion end portion 115 of the housing body 110.

When the conventional connector is to be used, a terminal 130 having a contact piece 131 formed at an end portion thereof and having an electric wire 132 connected to the other end thereof is inserted into a terminal accommodating chamber 111 of the housing body 110 by way of an end opening adjacent the cover 113 (left end opening in FIG. 11). At a position at which the terminal 130 is inserted fully in the terminal accommodating chamber 111, the terminal 130 is arrested at the engaging hole 133 thereof by the arresting projection 114 of the terminal accommodating chamber 111 so that it is thereafter held at the position.

Also the other terminals 130 are accommodated successively into the other terminal accommodating chambers 111, and then, the cover 113 is closed to cause the arresting projection 116 thereon to be arrested by the arresting projection not shown of the housing body 110, thereby completing assembly of the housing body 110.

Subsequently, the cover 113 is opened and the insertion end portion 115 of the housing body 110 is inserted into the cavity 121 of the casing 120 with the cover 113 positioned on the printed conductor 122 side as shown in FIG. 12. At the thus completely inserted position of the housing body 110, the arresting projection 118 of the flexible arresting piece 117 thereof is arrested by the engaging projection 125 of the casing 120 so that the housing body 110 is held at its position in which it is inserted completely in the casing 120. Upon insertion of the housing body 110, the contact piece 131 of each of the terminals 130 slidably moves on and contacts with the contact terminal 124 of the corresponding printed conductor 122 of the casing 120 to establish electric connection between them.

Since the conventional connector is constructed in such a manner as described above, it has a drawback that, when the terminals 130 are inserted into the terminal accommodating chambers 111 of the housing body 110, even if any one of them is in an incompletely or half inserted condition, if this is overlooked, then since the cover 113 of the housing body 110 can still be closed similarly as in a regular condition, it will be forwarded to a next step and consequently, inadvertently much time will be taken for the discovery of a trouble in an actually assembled condition of the connector.

Another exemplary one of conventional connectors is disclosed in Japanese Utility Model Laid-Open Application No. 53-146982 and is shown in FIGS. 13 and 14. The connector shown is similar to and different from the connector shown in FIGS. 10 to 12 only in that it includes a modified cover 142 and a mounting structure for the same. Accordingly, description is given only of the cover 142 and the mounting structure to avoid redundancy.

The cover 142 is provided for sliding movement in a pair of grooves 144 formed on a housing body 140 adjacent contact pieces 151 of terminals 150 individually accommodated in a plurality of terminal accommodating chamber 141 of the housing body 140, and a pair of open door stoppers 145 are formed at a portion adjacent an end of the cover 142 while an operating projection 146 in the form of a laterally bent tab is formed at the end of the cover 142 remote from the open door stoppers 145. A pair of engaging recesses 148 are formed on a side plate 147 which extends between a pair of outer side portions of the housing body 140 on the opposite sides of the groove 144. The engaging recesses 148 constitute engaging means for engaging with the open door stoppers 145.

Since the present connector is constructed in such a manner as described above, when it is to be assembled, the terminals 150 are successively accommodated into the individual terminal accommodating chambers 141, and then the cover 142 is slidably moved to be closed.

Thereupon, the operating projection 146 of the cover 142 is abutted with and stopped by an end edge of the side plate 147 of the housing body 140 while a protrusion 149 on the cover 142 is engaged with the inner face of the side plate 147 to hold the cover 142 at the closed position.

When the housing body 140 is to be inserted into a casing 120 which is similar to the casing 120 of the connector shown in FIGS. 10 to 12, the cover 142 is slidably moved along the grooves 144 to its open position. Thereupon, the open door stoppers 145 of the cover 142 are engaged with and stopped by the engaging recesses 148 of the side plate 147. Thereafter, the arrangement is operated in a similar manner as the arrangement shown in FIGS. 10 to 12 to assemble the housing body 140 and the casing 120.

Since the present connector is constructed in such a manner as described above, even if a terminal 150 is inserted into a terminal accommodating chamber 141 of the housing body 140 but to an intermediate or incompletely inserted position and then this is overlooked, since the cover 142 of the housing body 140 can still be closed in a similar manner as in a case wherein all of the terminals 150 are inserted to individually fully inserted positions thereof, the arrangement thus assembled will be forwarded to a next step as it is. Therefore, inadvertently much time will be taken for the discovery of a trouble which arises from the particular terminal 150 inserted to the incompletely inserted position in the assembled arrangement.

SUMMARY OF THE INVENTION

It is an object of the present invention to provide a connector with a cover for connecting an electric wire to a printed circuit board or a like element which allows detection of an incompletely inserted condition of a terminal thereof.

In order to attain the object, according to the present invention, there is provided a connector assembly, which comprises a housing body having a terminal accommodating chamber formed therein, a terminal accommodated in the terminal accommodating chamber of the housing body and having a contact piece on one side thereof, a cover made of an insulating member and hinged at an end thereof on the housing body adjacent the contact piece of the terminal, and a companion casing having a cavity formed therein for receiving the housing body therein, the companion further having a contact terminal extending to an inner face of the cavity for contacting with the contact piece of the terminal, the hinge portion of the cover being extended remote from the other end of the cover to form a detecting projection, the terminal having a protrusion formed thereon so as to interfere, when the terminal is not accommodated in position in the terminal accommodating chamber of the housing body with the detecting projection of the cover to prevent pivotal motion of the cover to a predetermined position. The protrusion of the terminal may be formed from a pair of projections extending from a pair of side plates of an intermediate portion of the terminal and bent at end portions thereof laterally inwardly toward each other.

With the connector assembly, when the terminal is not accommodated in position, that is, when the terminal is not inserted fully in the terminal accommodating chamber of the housing body, the protrusion of the terminal interferes with the detecting projection of the cover, and consequently, the cover cannot be pivoted to the predetermined position, that is, the cover cannot be closed fully. Accordingly, the incompletely inserted condition of the terminal can be detected with certainty from the fact.

According to another aspect of the present invention, there is provided a connector assembly, which comprises a housing body having a terminal accommodating chamber formed therein and having a pair of slide grooves formed thereon, a terminal accommodated in the terminal accommodating chamber of the housing body and having a contact piece on one side thereof, the terminal being connected at an end remote from the contact piece to an electric wire, a cover made of an insulating member and fitted for sliding movement in the slide grooves of the housing body, a companion casing having a cavity formed therein for receiving the housing body therein, the companion further having a contact terminal extending to an inner face of the cavity for contacting with the contact piece of the terminal, the housing body further having a pair of grooves formed at portions thereof remote from the electric wire in a first direction intersecting a second direction in which the terminal is inserted in the terminal accommodating chamber of the housing body, and a retainer removably mounted in the grooves and having a pair of cover guide grooves formed thereon such that the cover guide grooves are aligned with the slide grooves when the retainer is at a predetermined position with respect to the housing body, the retainer having a final arresting projection and a temporary arresting projection formed at outer portions thereof while the housing body has a final engaging projection and a temporary engaging projection formed thereon for engaging with the final arresting projection and the temporary arresting projection, respectively, to arrest the terminal doubly with the retainer in two stages, the retainer having a detecting projection formed at an end of a horizontal plate portion thereof adjacent the terminal accommodating chamber while the terminal has a projection formed thereon so as to interfere, when the terminal is not accommodated in position in the terminal accommodating chamber of the housing body, with the detecting projection of the retainer to prevent movement of the retainer to the predetermined position.

With the connector assembly, when the terminal is not accommodated in position, that is, when the terminal is not inserted fully in the terminal accommodating chamber of the housing body, the projection of the terminal interferes with the detecting projection of the retainer, and consequently, the retainer cannot be moved to the predetermined position, that is, the retainer cannot be inserted fully to its finally arrested position. Besides, in this condition, the cover moving grooves of the retainer and the slide grooves of the housing body are not registered with each other and are offset from each other, and consequently, the cover on the housing body cannot be slidably moved into the retainer. Accordingly, the incompletely inserted condition of the terminal can be detected with certainty from the fact.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
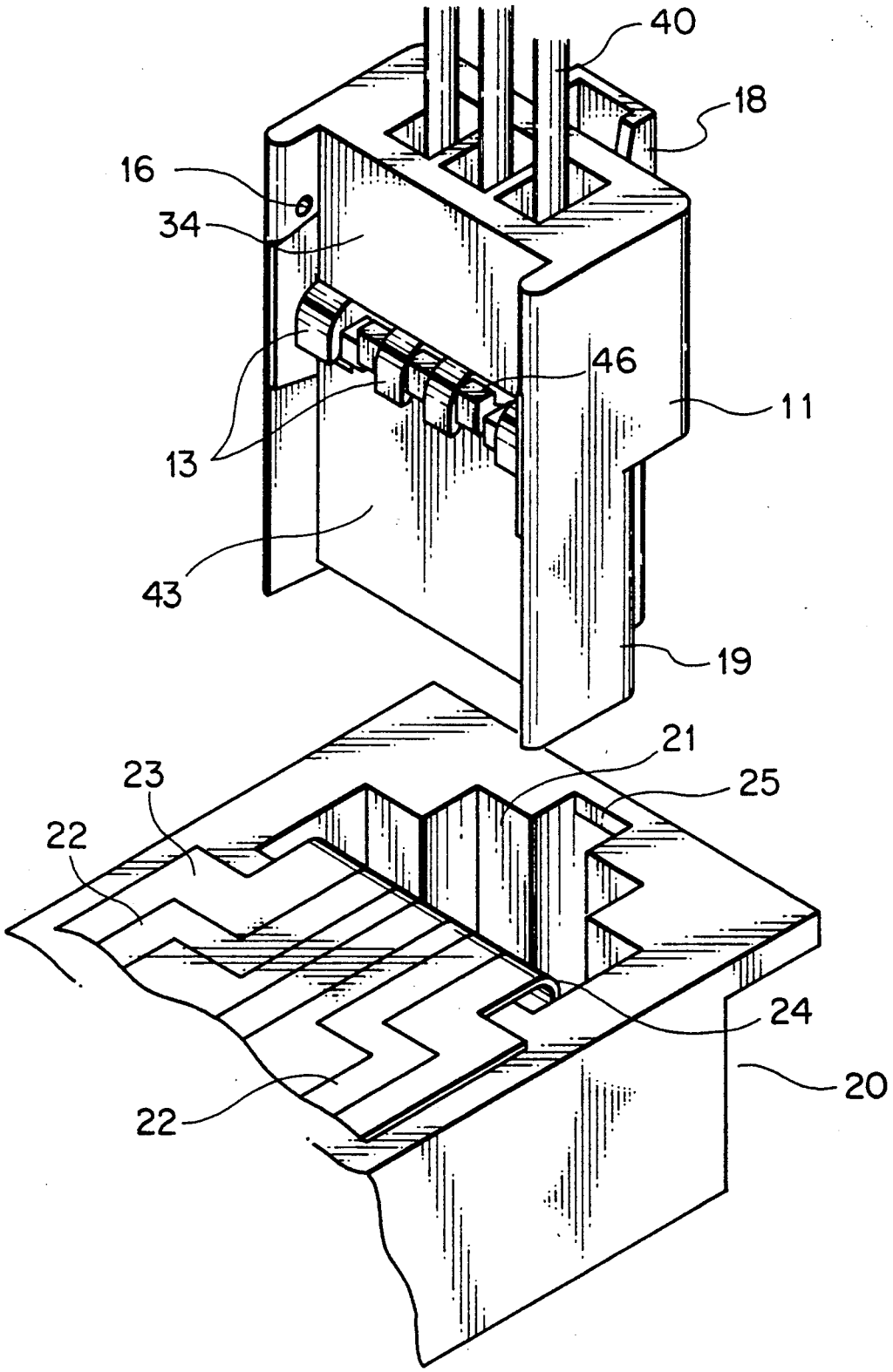
FIG. 1 is a fragmentary perspective view of a connector showing a first preferred embodiment of the present invention.
Figure 2:
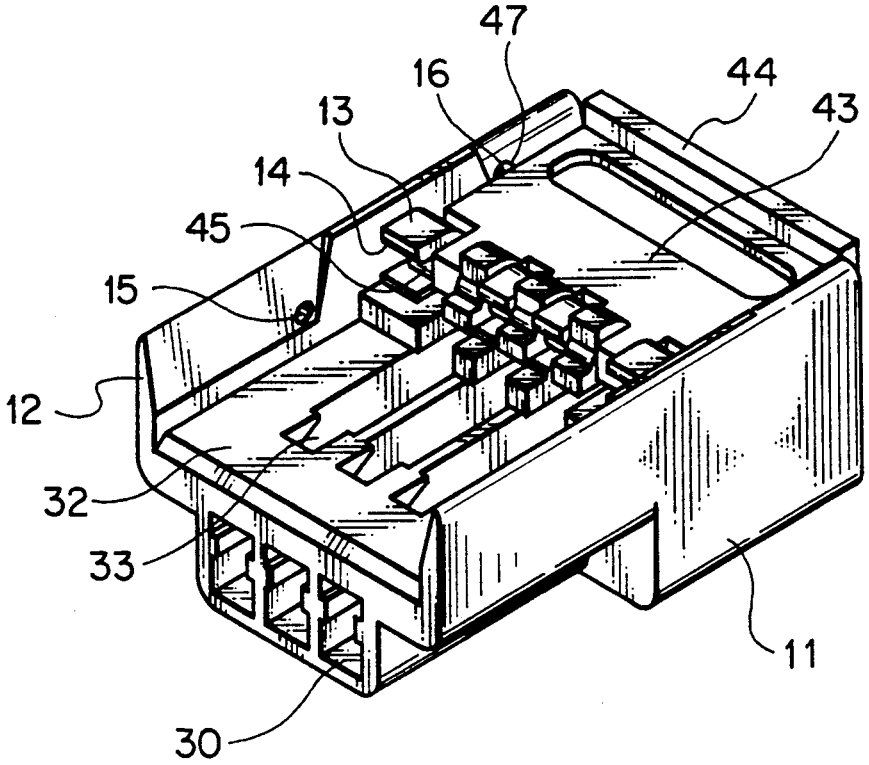
FIG. 2 is a perspective view of a housing body of the connector of FIG. 1 with a cover thereof opened.
Figure 3:
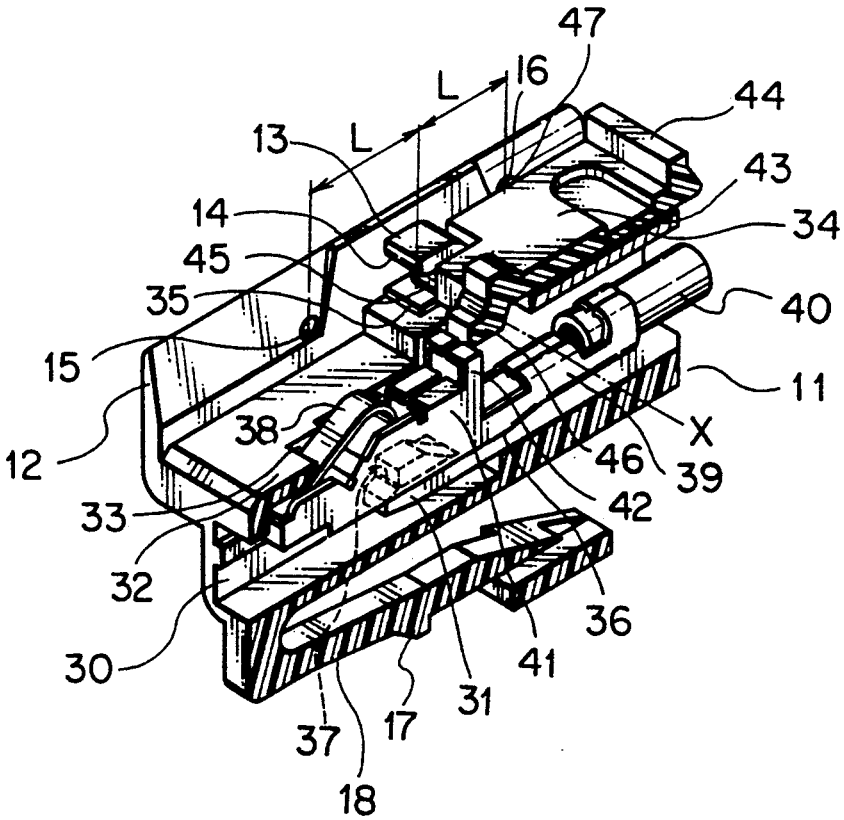
FIG. 3 is a perspective view, partly in section, of the housing body of FIG. 2.

Referring first to FIGS. 1 to 3, there is shown a connector to which the present invention is applied. The connector shown includes a housing body 11 having a plurality of terminal accommodating chambers 30 formed thereon. Each of the terminal accommodating chamber 30 has a flexible arresting piece 31 provided projectingly on an inner wall thereof, and a terminal 36 is accommodated in each of the terminal accommodating chambers 30. The terminal 36 has an engaging hole 37 formed in a rear wall adjacent an end portion thereof and has a contact piece 38 formed such that it is folded back over itself from an end to an intermediate portion thereof. The terminal 36 is connected at an electric wire connecting portion 39 at the other end portion thereof to an electric wire 40.

The engaging hole 37 of the terminal 36 cooperates with the flexible arresting piece 31 of the corresponding terminal accommodating chamber 30 to constitute arresting means for arresting the terminal 36 at the housing body 11.

A protrusion 42 is formed at a substantially mid portion of the terminal 36 between the contact piece 38 and the electric wire connecting portion 39 by laterally bending a pair of side plates 41 of the terminal 36 inwardly toward each other, and a top plate 32 of the corresponding terminal accommodating chamber 30 is partially cut away to define a slot 33 through which the contact piece 38 and the protrusions 42 are exposed outwardly.

Another top plate 34 is disposed on the housing body 11 in a parallel offset relationship from the top plate 32, and a plurality of engaging portions 13 each having a channel-shaped longitudinal section are formed contiguously on the housing body 11 adjacent an end portion 35 of the top plate 34 adjacent the electric wire connecting portions 39 of the terminals 36 except above the terminals 36 with opening ends 14 thereof directed away from the electric wire connecting portions 39 of the terminals 36.

A pair of engaging holes 15 and 16 are formed on the inner face of each of a pair of side plates 12 of the housing body 11 in a uniformly spaced relationship by a distance L from an axial line X of a cover 43 (which axial line X is also an axial line of the engaging portions 13).

The cover 43 has a lid piece 44 formed laterally uprightly at an end thereof such that it has an L-shaped longitudinal section while a plurality of trunnions 45 generally serving as a hinge for the cover 43 are formed at the other end of the cover 43 except above the terminals 36 and cooperate with the engaging portions 13 of the housing body 11 to constitute pivotally supporting means for pivotally supporting the cover 43. The cover 43 extends, at the other end thereof, above the terminals 36 beyond the axial line X which interconnect the centers of the trunnions 45 to form a plurality of detecting projections 46 on the cover 43 in a suitably offset condition from the trunnions 45.

The distance from the axial line X to the ends of the detecting projections 46 is set to a maximum value within a range wherein the loci of the ends of the detecting projections 46 do not come to the protrusions 42 of the terminals 36 at their completely inserted positions. A pair of engaging projections 47 are formed on the opposite side ends of the cover 43 at the distance L from the axial line X of the trunnions 45 and constitute engaging means for engaging with the engaging holes 15 or 16 of the housing body 11.

A flexible arresting piece 18 is formed on a side face of the housing body 11 remote from the cover 43 and has an arresting projection 17 formed on an outer face thereof. The arresting projection 17 of the flexible arresting piece 18 cooperates with an arresting projection 25 of a casing 20 to constitute arresting means for arresting the housing body 11 at the casing 20.

Referring to FIG. 1, the casing 20 has a cavity 21 formed at a portion adjacent an end thereof, and a circuit board portion 23 on which a plurality of printed conductors 22 are disposed is provided on and extends to the other end of the casing 20. The printed conductors 22 individually have contact terminals 24 facing the cavity 21, and the contact terminals 24 constitute contacting means for contacting with the contact pieces 38 of the terminals 36 in the housing body 11. Further, the cavity 21 constitutes receiving means for receiving an insertion end portion 19 of the housing body 11 therein.

Figure 4A:
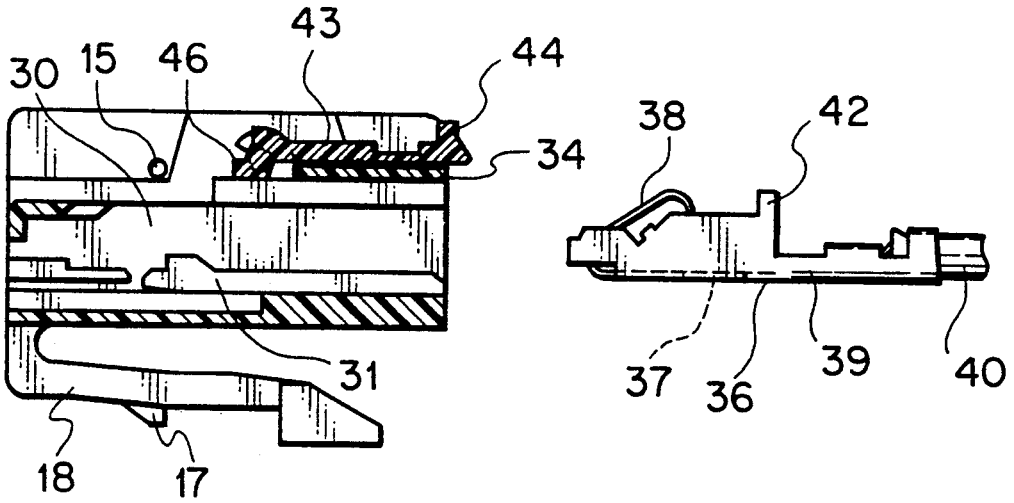
FIGS. 4*a*, 4*b* and 4*c* are longitudinal sections showing different stages of insertion of a terminal into the housing body of FIG. 2.

When the connector is to be used, the terminals 36 are individually inserted into the terminal accommodating chambers 30 of the housing body 11 with the contact pieces 38 thereof directed to the cover 43 as seen in FIG. 4*a*.

In this instance, at the individually completely inserted positions of the terminals 36, the terminals 36 are arrested at the engaging holes 37 thereof by the ends of the flexible arresting pieces 31 so that they are prevented from being pulled off from the terminal accommodating chambers 30 of the housing body 11. Meanwhile, since the length of the detecting projections 46 of the cover 43 is set to a maximum value within the range within which the loci of the ends of the detecting projections 46 of the cover 43 do not come to the protrusions 42 of the terminals 36 at the completely inserted positions, when all of the terminals 36 are at their individually fully inserted positions, the cover 43 can be pivoted over about 180 degrees from its position shown in FIG. 4*b* to its closed position, at which the engaging projections 47 are engaged with the engaging holes 14, in the direction indicated by an arrow mark in FIG. 4*c* while the detecting projections 46 of the cover 43 do not collide with the protrusions 42 of the terminals 36.

Figure 4B:
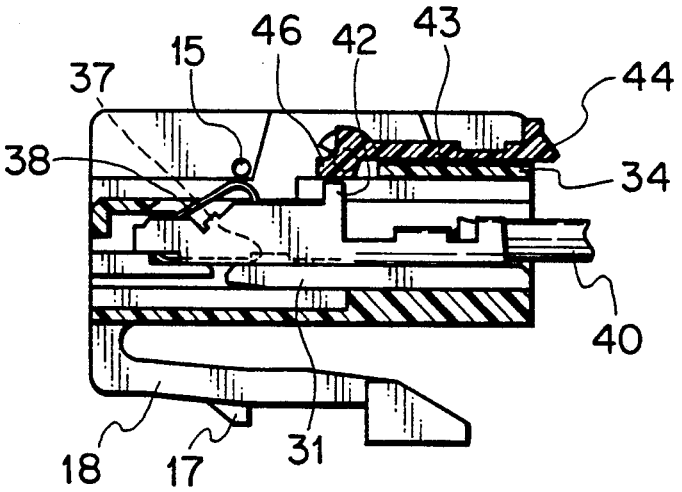
Figure 4C:
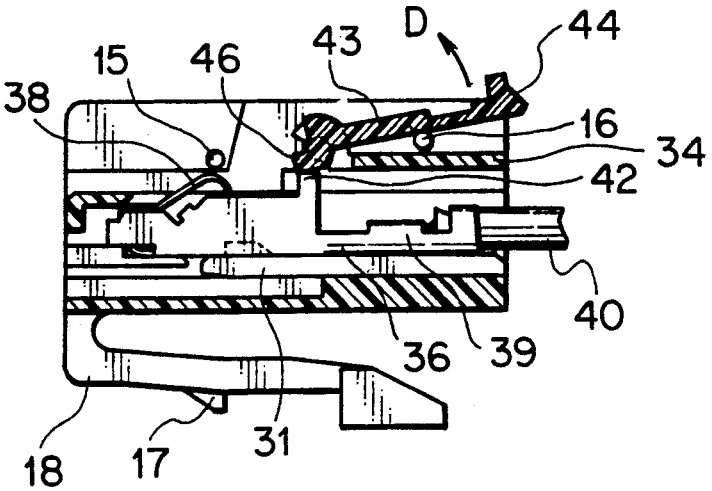

However, in case at least one of the terminals 36 is at an incompletely inserted position as seen in FIG. 4*b*, the protrusion 42 of the terminal 36 is positioned within the locus of the end of the corresponding detecting projection 46, and accordingly, when it is tried to pivot the cover 43 in the closing direction D as indicated by the arrow mark in FIG. 4*c*, the end of the detecting projection 46 collides with the protrusion 42 of the terminal 36 as seen from FIG. 4*c* to prevent the cover 43 from being pivoted to its closed position. Consequently, the incompletely inserted condition of the terminal 36 is detected with certainty in a fool-proof fashion.

Figure 5:
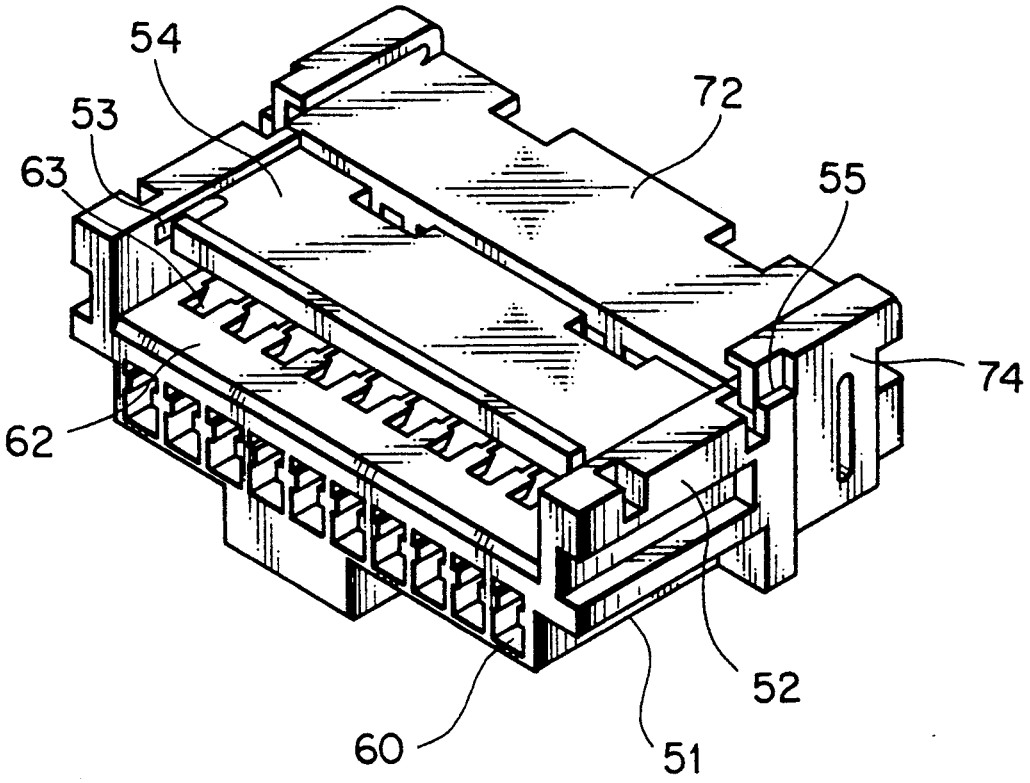
FIG. 5 is a perspective view of a housing body of another connector showing a second preferred embodiment of the present invention.
Figure 8A:
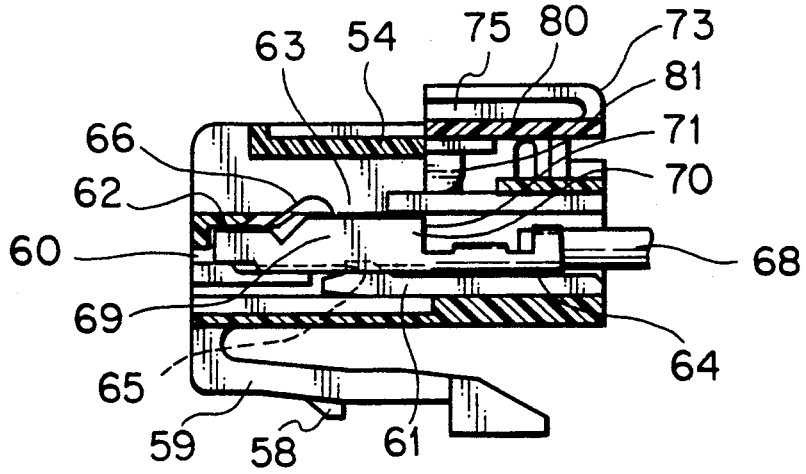
FIGS. 8*a*, 8*b* and 8*c* are longitudinal sectional views of the housing body of FIG. 5 when the retainer is at different positions.

Referring now to FIG. 5, there is shown a connector according to another preferred embodiment of the present invention. Referring also to FIG. 8*a*, the connector shown includes a housing body 51 having a plurality of terminal accommodating chambers 60 formed therein. Each of the terminal accommodating chambers 60 has a flexible arresting piece 61 formed projectingly on an inner wall thereof and has a terminal 64 accommodated therein. The terminal 64 has an engaging hole 65 formed in a rear wall adjacent an end portion thereof and has a contact piece 66 formed thereon such that it is folded back over itself from an end to an intermediate portion thereof. A projection 70 is formed by bending a pair of side plates 69 of the terminal 64 laterally inwardly toward each other, and an electric wire 68 is connected to an electric wire connecting portion 67 at the other end portion of the terminal 64.

A top plate 62 of the terminal accommodating chamber 60 is partially cut away to form therein a slot 63 through which the contact piece 66 of the corresponding terminal 64 is exposed to the outside. The engaging holes 65 of the terminals 64 cooperate with the flexible arresting pieces 61 of the terminal accommodating chambers 60 to constitute arresting means for arresting the terminals 64 at the body housing 51.

A pair of slide grooves 53 are formed in an opposing relationship on the inner sides of a pair of side plates 52 of the housing body 51 and constitute sliding means for slidably receiving the cover 54 therein, and a pair of recesses 55 for engaging with a pair of side plate 74 of a retainer 72 are formed on the opposite sides of the housing body 51 adjacent the electric wire connecting end such that they extend in directions intersecting the inserting direction of the terminals 64. Further, a pair of temporary engaging projections 56 and a pair of final engaging projections 57 are formed on the opposite sides of the housing body 51 adjacent the electric wire connecting end side.

The retainer 72 has an H-shaped transverse section and can be mounted and dismounted in a direction intersecting the inserting direction of the terminals 64.

A pair of cover moving grooves 76 are formed on the inner sides of minor portions 75 of a pair of side plates 74 of the retainer 72 while a plurality of detecting projections 81 are formed contiguously on a horizontal plate 80 of the retainer 72 adjacent the projections 70 of the terminals 64 and cooperate with the end edges 71 of the projections 70 of the terminals 64 to constitute dual arresting means for arresting the terminals 64 at the housing body 51.

A pair of temporary arresting projections 79 are formed on the inner sides of the ends of major portions 77 of the side plates 74, and a pair of final arresting projections 78 are formed on the major portions 77 of the side plates 74 adjacent the electric wire connecting ends of the terminals 64, to which electric wires 68 are individually connected, and cooperate with a pair of temporary engaging projections 56 and a pair of final engaging projections 57 of the housing body 51, respectively.

It is to be noted that the cover moving grooves 76 of the retainer 72 are set such that they lie, at a finally arrested position wherein the final engaging projections 78 of the retainer 72 are engaged with the final engaging projections 57, on a common axial line with the slide grooves 53 of the housing body 51.

Referring to FIG. 8*a*, a flexible arresting piece 59 is provided on the outer side of a side face of the housing body 51 remote from the cover 54 and has an arresting projection 58 formed thereon. The flexible arresting piece 59 cooperates with an engaging projection not shown of a casing which is not shown in any of FIGS. 5 to 8*c* but is similar to the casing 20 shown in FIG. 1.

Figure 6A:
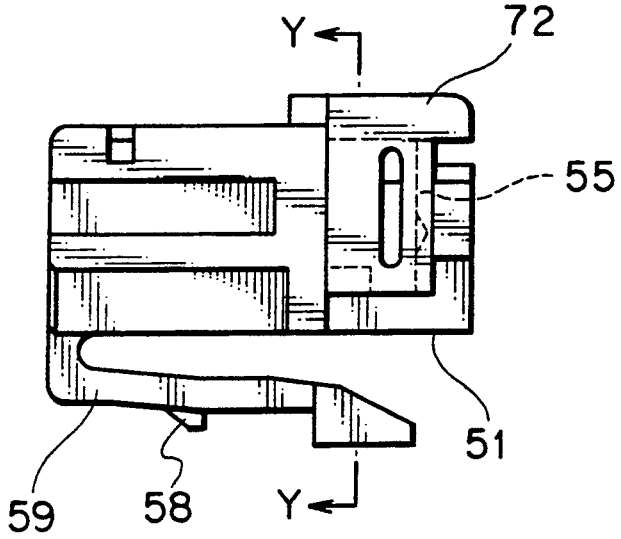
FIG. 6*a* is a side elevational view of the housing body of FIG. 5.
Figure 6B:
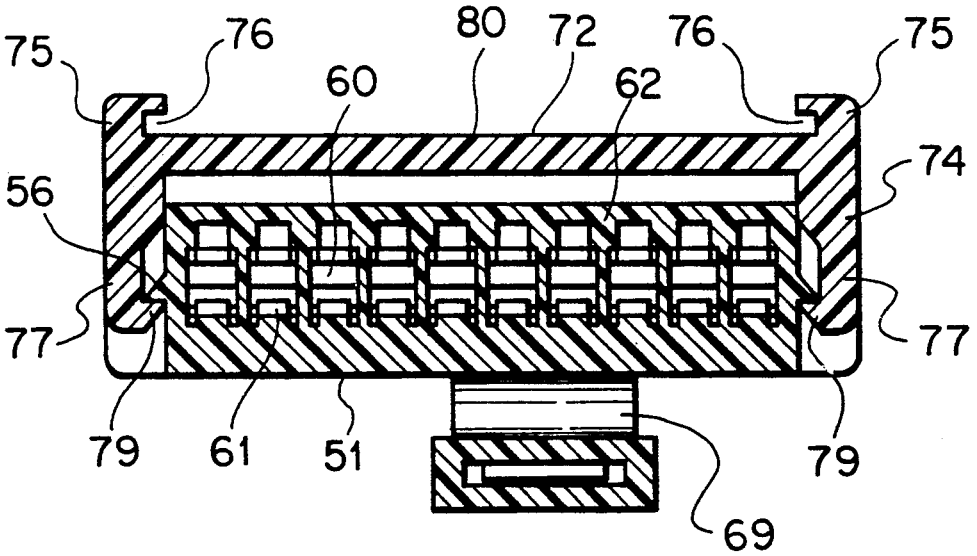
FIG. 6*b* is an enlarged sectional view taken along line Y—Y of FIG. 6*a;*
Figure 7A:
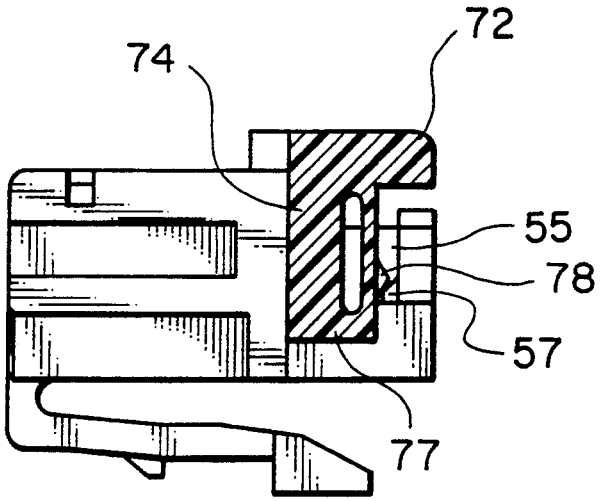
FIGS. 7*a* and 7*b* are side elevational views, partly in section, of the housing body of FIG. 5 when a retainer is at a temporarily arrested position and a finally arrested position, respectively.

When the connector is to be used, the side plates 74 of the retainer 72 are first inserted into the grooves 55 of the housing body 51 until the temporary arresting projections 79 of the retainer 72 are arrested at a position at which they engage with the temporary engaging projections 56 of the housing body 51 as shown in FIG. 6*b* to hold the retainer 72 at its temporarily arresting position but the final arresting projections 78 of the retainer 72 do not ride over the final engaging projections 57 of the housing body 51 as yet as shown in FIGS. 6*b* and 7*a*.

Subsequently, a terminal 64 is inserted into a terminal accommodating chamber 60 of the housing body 11 with the contact piece 66 side thereof directed to the slot 63 of the terminal accommodating chamber 60. When it is inserted to its completely inserted position, the engaging hole 65 of the terminal 64 is arrested by the flexible arresting piece 61 of the terminal accommodating chamber 60 thereby to prevent the terminal 64 from being pulled off from the terminal accommodating chamber 60. The other terminals 64 are successively accommodated into the corresponding terminal accommodating chambers 60 in a similar manner, thereby completing assembly of the terminals 64 as shown in FIG. 8*a*.

Figure 7B:
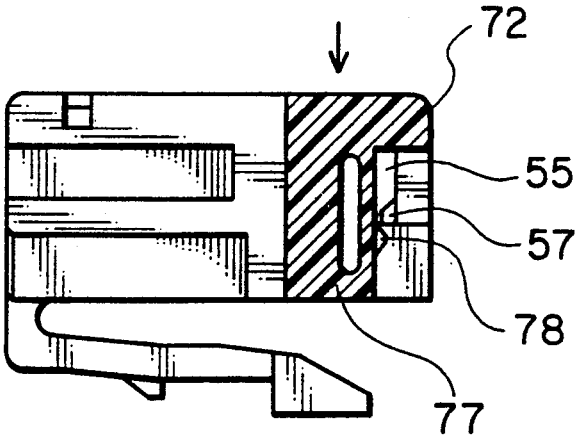
Figure 8B:
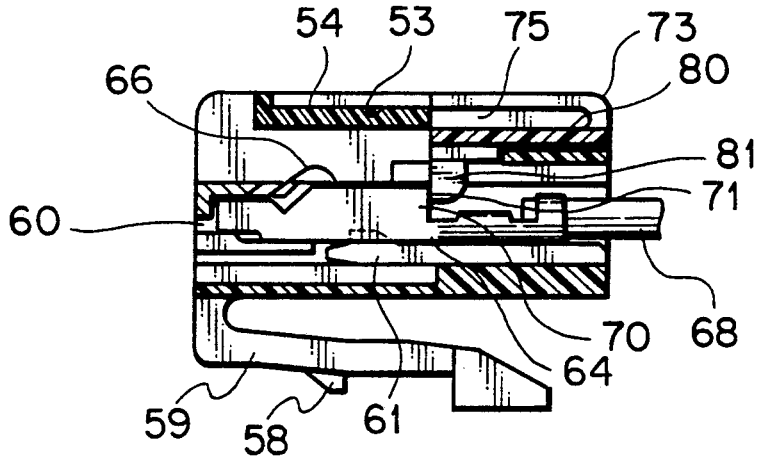

Subsequently, the retainer 72 is inserted fully in the direction indicated by an arrow mark in FIG. 7*b*. Thereupon, the final arresting projections 78 of the retainer 72 ride over the final engaging projections 57 of the housing body 51 and come to a finally arrested position at which they are arrested by the final engaging projections 57. Consequently, the cover moving grooves 76 of the retainer 72 are positioned on the same axial line, i.e., aligned with the slide grooves 53 of the housing body 51 while the detecting projections 81 of the retainer 72 are abutted with the end edges 71 of the projections 70 of the terminals 64 as shown in FIG. 8*b* to arrest the terminals 64 doubly.

Figure 8C:
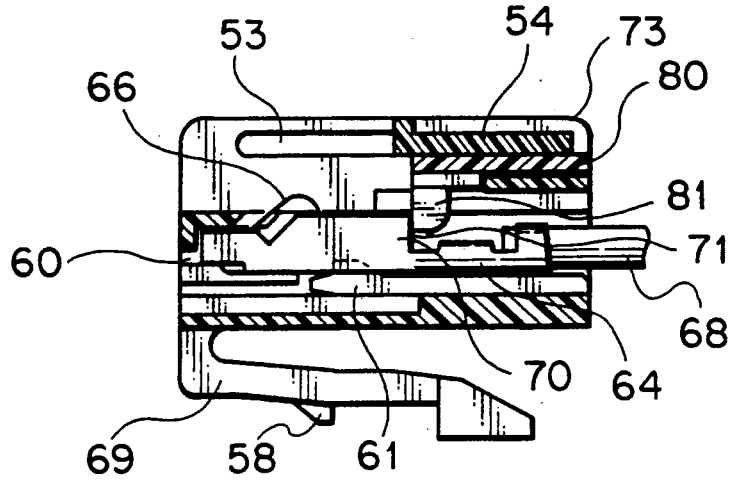
Figure 10:
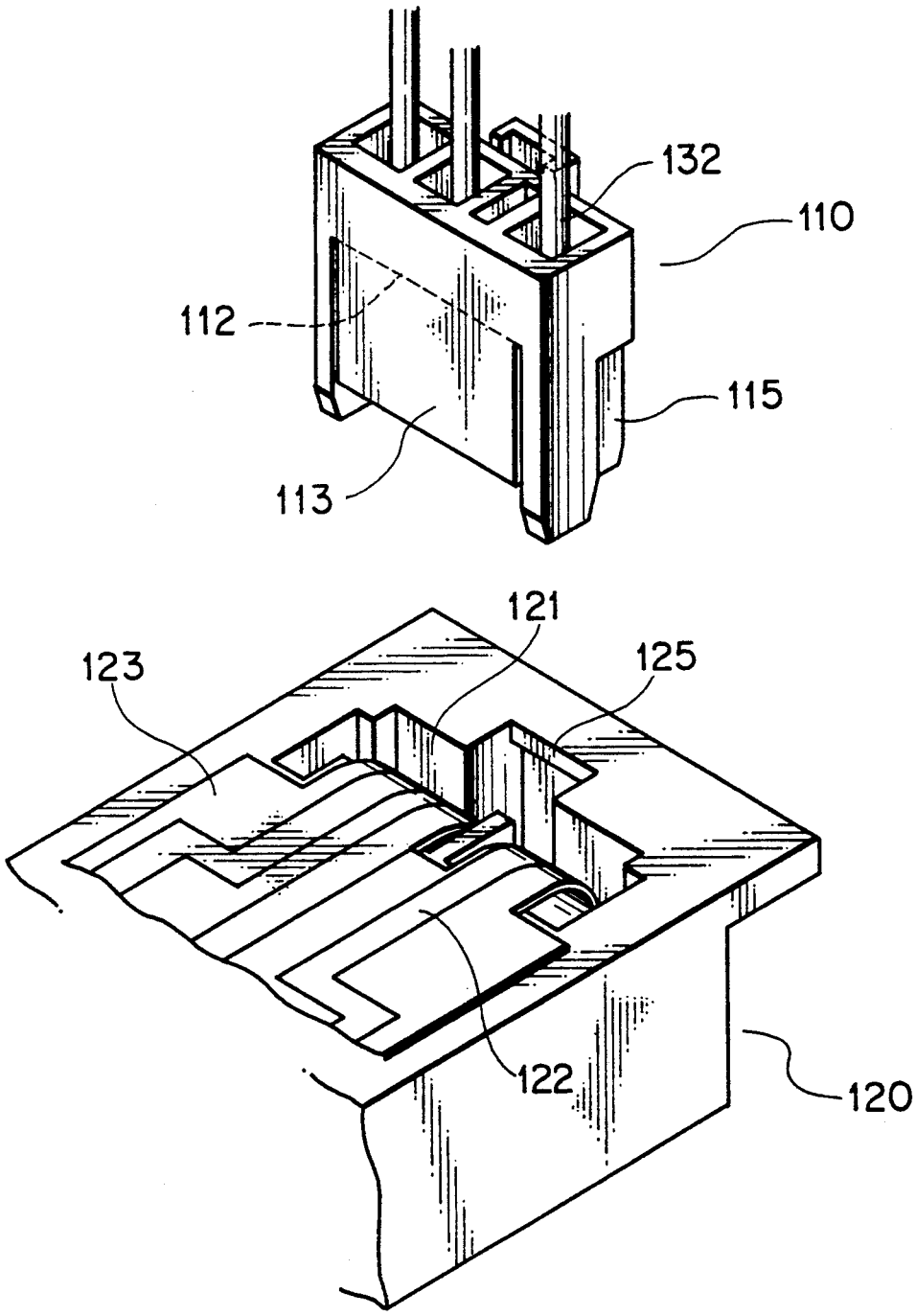
FIG. 10 PRIOR ART
FIG. 10 is a fragmentary perspective view showing an exemplary conventional connector.
Figure 11:
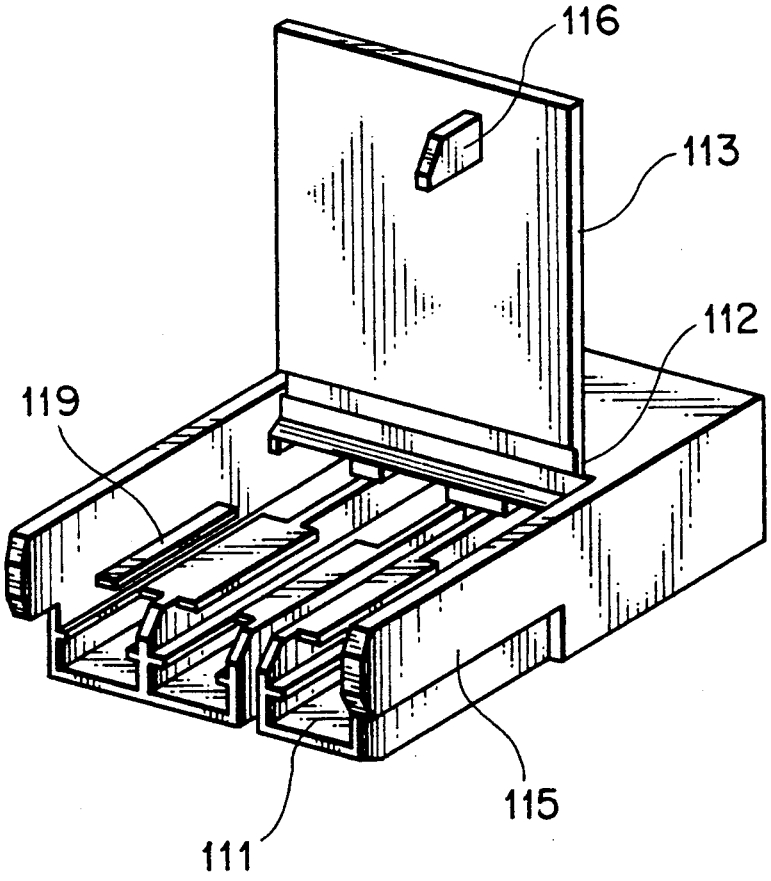
FIG. 11 PRIOR ART
FIG. 11 is a perspective view of a housing body of the connector of FIG. 10 with a cover thereof opened.
Figure 12:
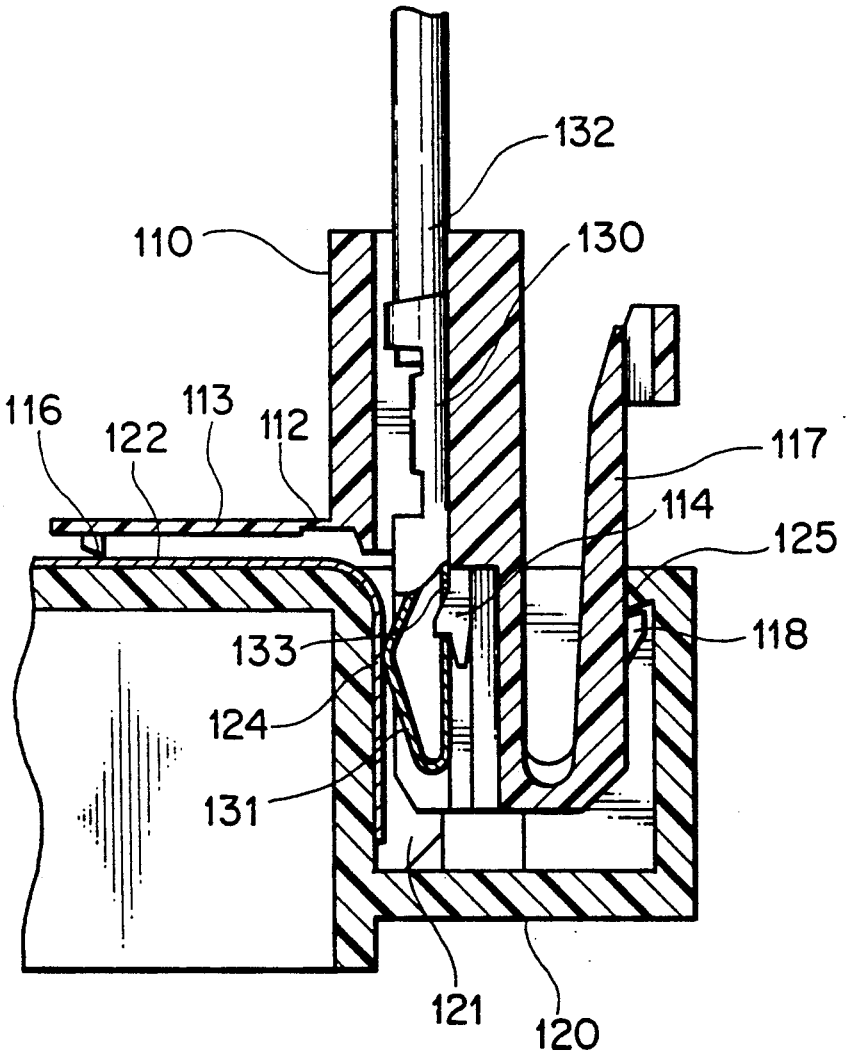
FIG. 12 PRIOR ART
FIG. 12 is a longitudinal sectional view of the connector of FIG. 10 in an assembled condition.
Figure 13:
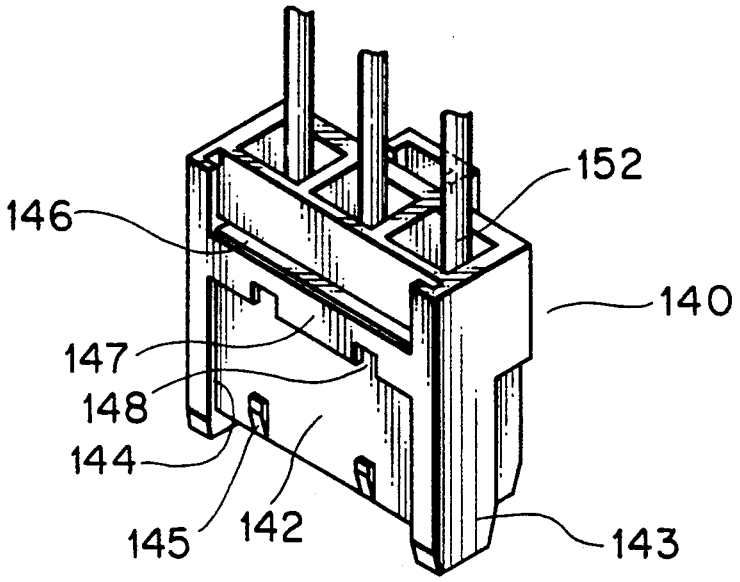
FIG. 13 PRIOR ART
FIG. 13 is a fragmentary perspective view of another exemplary conventional connector.
Figure 13:
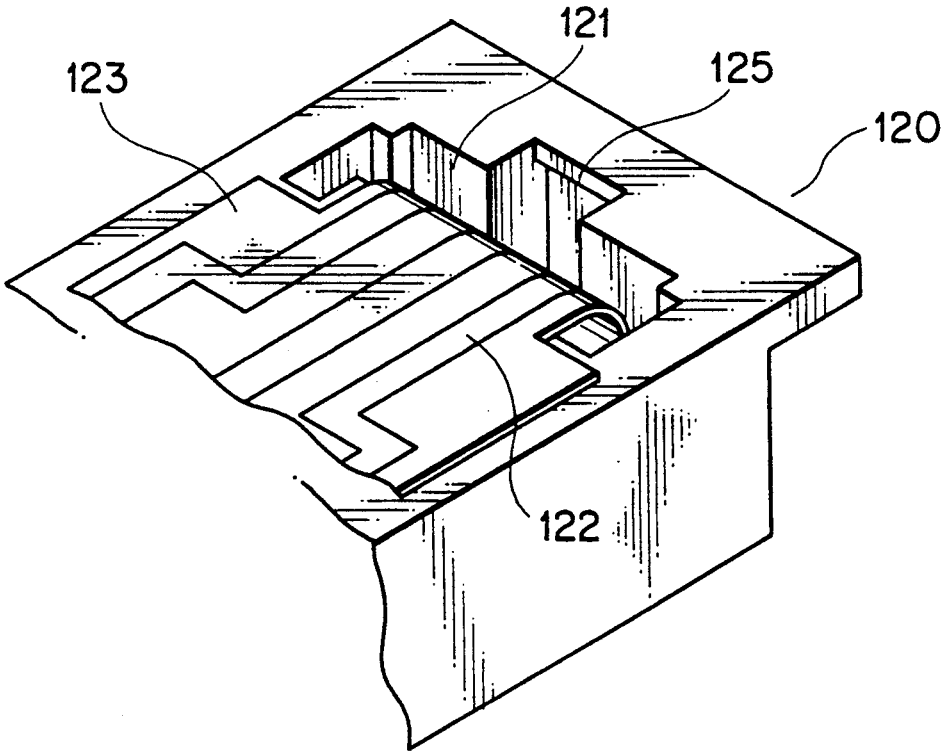
FIG. 13 PRIOR ART
Figure 14:
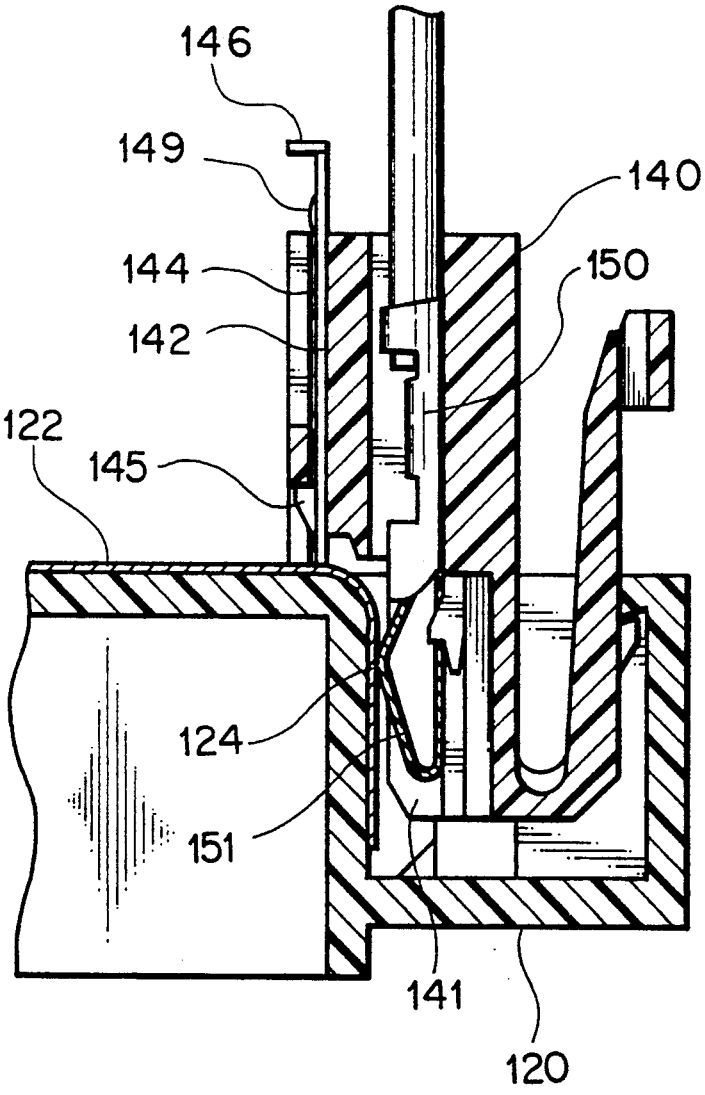
FIG. 14 PRIOR ART
FIG. 14 is a longitudinal sectional view of the connector of FIG. 13 in an assembled condition.

While assembly of the housing body 51 is completed with this, when the housing body 51 is to be inserted into the companion casing, the cover 54 should be inserted into and slidably moved in the cover moving grooves 76 of the retainer 72 as shown in FIG. 8*c* watching the contact pieces 66 of the terminals 64.

Figure 9:
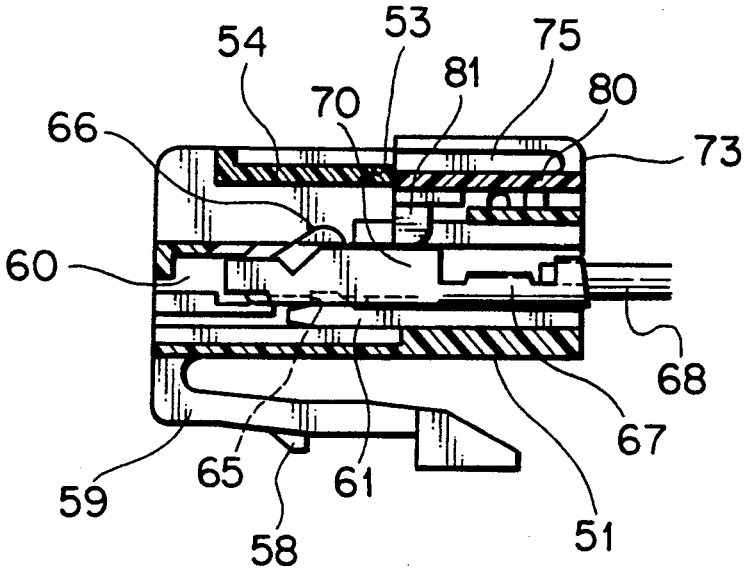
FIG. 9 is a similar view but showing the retainer on the housing body of FIG. 5, when a terminal remains in an incompletely inserted position.

In this instance, however, if one of the terminals 64 is at its incompletely inserted position as shown in FIG. 9, then even if it is tried to insert the retainer 72 fully to its finally arrested position, a corresponding one of the detecting projections 81 of the retainer 72 will collide with the upper end of the projection 70 of the terminal 64, and consequently, the retainer 72 cannot be moved to its finally arrested condition as seen in FIG. 9. Besides, since the cover moving grooves 76 for the retainer 72 are not aligned with the slide grooves 53 of the housing body 51, the cover 54 cannot be slidably moved to its open position. Accordingly, incomplete insertion of the terminal 64 can be detected with certainty in a fool-proof fashion.

Having now fully described the invention, it will be apparent to one of ordinary skill in the art that many changes and modifications can be made thereto without departing from the spirit and scope of the invention as set forth herein.

What is claimed is:

1. A connector assembly, comprising:

a housing body having a terminal accommodating chamber formed therein:

a terminal accommodated in said terminal accommodating chamber of said housing body and having a contact piece on one side thereof;

a cover made of an insulating member and hinged at an end thereof on said housing body adjacent said contact piece of said terminal; and a companion casing having a cavity formed therein for receiving said housing body therein, said companion further having a contact terminal extending to an inner face of said cavity for contacting with said contact piece of said terminal;

the hinge portion of said cover being extended remote from the other end of said cover to form a detecting projection;

said terminal having a protrusion formed thereon so as to interfere, when said terminal is not accommodated in position in said terminal accommodating chamber of said housing body, with said detecting projection of said cover to prevent pivotal motion of said cover to a predetermined position.

2. A connector assembly as claimed in claim 1, wherein said protrusion of said terminal is formed from a pair of projections extending from a pair of side plates of an intermediate portion of said terminal and bent at end portions thereof laterally inwardly toward each other.

3. A connector assembly, comprising:

a housing body having a terminal accommodating chamber formed therein and having a pair of slide grooves formed thereon:

a terminal accommodated in said terminal accommodating chamber of said housing body and having a contact piece on one side thereof, said terminal being connected at an end remote from said contact piece to an electric wire;

a cover made of an insulating member and fitted for sliding movement in said slide grooves of said housing body;

a companion casing having a cavity formed therein for receiving said housing body therein, said companion further having a contact terminal extending to an inner face of said cavity for contacting with said contact piece of said terminal;

said housing body further having a pair of grooves formed at portions thereof remote from said electric wire in a first direction intersecting a second direction in which said terminal is inserted in said terminal accommodating chamber of said housing body; and a retainer removably mounted in said grooves and having a pair of cover guide grooves formed thereon such that said cover guide grooves are aligned with said slide grooves when said retainer is at a predetermined position with respect to said housing body;

said retainer having a final arresting projection and a temporary arresting projection formed at outer portions thereof while said housing body has a final engaging projection and a temporary engaging projection formed thereon for engaging with said final arresting projection and said temporary arresting projection, respectively, to arrest said terminal doubly with said retainer in two stages:

said retainer having a detecting projection formed at an end of a horizontal plate portion thereof adjacent said terminal accommodating chamber while said terminal has a projection formed thereon so as to interfere, when said terminal is not accommodated in position in said terminal accommodating chamber of said housing body, with said detecting projection of said retainer to prevent movement of said retainer to the predetermined position.

* * * * *